US008495845B2

(12) United States Patent
Perrin et al.

(10) Patent No.: US 8,495,845 B2
(45) Date of Patent: Jul. 30, 2013

(54) WALL ASSEMBLY

(75) Inventors: Jonathon Gilbert Francis Perrin, Brisbane (AU); Gerard Michael Ryan, Brisbane (AU)

(73) Assignee: Steel Storage Holdings Pty Ltd., Hendra, Queensland (AU)

( * ) Notice: Subject to any disclaimer, the term of this patent is extended or adjusted under 35 U.S.C. 154(b) by 593 days.

(21) Appl. No.: 11/913,987

(22) PCT Filed: May 22, 2006

(86) PCT No.: PCT/AU2006/000674

§ 371 (c)(1),
(2), (4) Date: Jan. 3, 2008

(87) PCT Pub. No.: WO2006/122375

PCT Pub. Date: Nov. 23, 2006

(65) Prior Publication Data

US 2008/0190056 A1 Aug. 14, 2008

(30) Foreign Application Priority Data

May 20, 2005 (AU) ..... 2005902629

(51) Int. Cl.

| | |
|---|---|
| ***E04B 2/00*** | (2006.01) |
| ***E02D 27/00*** | (2006.01) |
| ***E04B 1/00*** | (2006.01) |
| *E04B 1/26* | (2006.01) |
| *E04F 19/04* | (2006.01) |

(52) U.S. Cl.

CPC ..... *E04B 1/0007* (2013.01); *E04B 2001/2688* (2013.01); *E04F 19/0436* (2013.01); *E04F 19/0495* (2013.01); *E04F 2019/0413* (2013.01)

USPC ..... 52/293.3; 52/288.1

(58) Field of Classification Search

USPC ..... 52/236.9, 238.1, 243.1, 288.1, 292, 52/293.3, 300, 745.05, 745.2, 473, 537, 783.11, 52/798.1

See application file for complete search history.

(56) References Cited

U.S. PATENT DOCUMENTS

| | | | | |
|---|---|---|---|---|
| 3,568,388 | A * | 3/1971 | Flachbarth et al. | 52/588.1 |
| 3,631,647 | A * | 1/1972 | Merkin | 52/300 |
| 3,633,327 | A * | 1/1972 | Klingensmith et al. | 52/300 |
| 3,745,593 | A * | 7/1973 | Wall | 52/169.7 |
| 3,807,103 | A * | 4/1974 | Kautz et al. | 52/58 |
| 4,272,060 | A * | 6/1981 | Stafford | 256/24 |

(Continued)

FOREIGN PATENT DOCUMENTS

| | | |
|---|---|---|
| AU | 29442/84 | 12/1984 |
| DE | 29912785 | 10/1999 |

(Continued)

*Primary Examiner* — Basil Katcheves
*Assistant Examiner* — Theodore Adamos
(74) *Attorney, Agent, or Firm* — Shoemaker and Mattare

(57) ABSTRACT

A securing cap, for use in fixing a wall with a floor or ceiling mounting, is snap fit within the space between the wall and a floor or ceiling mounting thereby fixing each component in position. The securing cap, in conjunction with other such caps, holds a wall assembly in a desired position in a building or shed where wall panels are positioned relative to each other to form a wall. The securing cap also serves to prevent the accumulation of dust and debris within the space formed by the wall and the floor or ceiling mountings.

9 Claims, 13 Drawing Sheets

U.S. PATENT DOCUMENTS

| | | | | |
|---|---|---|---|---|
| 5,289,663 | A | 3/1994 | Schluter | |
| 5,433,048 | A | 7/1995 | Strasser | |
| 5,619,837 | A * | 4/1997 | DiSanto | 52/798.1 |

FOREIGN PATENT DOCUMENTS

| | | |
|---|---|---|
| DE | 20315375 | 4/2004 |
| EP | 560748 | 9/1993 |
| EP | 608208 | 7/1994 |
| GB | 2322880 | 9/1998 |
| JP | 2004068324 | 3/2004 |

* cited by examiner (a)

(b)

WALL ASSEMBLY

BACKGROUND OF THE INVENTION

The present invention relates to the construction of walls and structures. The present invention has particular but not exclusive application for the assembly of walls and partitions for buildings and sheds to separate areas. By way of example, reference will be made to storage systems and storage sheds and buildings in the specification, but the invention is not limited to this application.

Storage sheds and buildings usually include a plurality of corrugated metal panels fixed by rivets or screws to each other. The continuous paneling is fixed by screws or rivets to flooring channels to form assembled walls. These walls serve to partition and secure areas for storage purposes. The requirement to use rivets and screws to fix panels is labor intensive and expensive.

As a consequence, a building system described in Australian Patent 705734 was developed with panels that have end locking return flanges so that adjacent panels can interlock with each other and avoid the need for the use of fasteners.

Nevertheless panels are still required to be fastened to flooring channels for wall assembly. The use of screws and rivets to fix and erect walls is time consuming and provides a plurality of unsightly protruding fasteners on the wall surface which can interfere with passage between opposing walls.

SUMMARY OF THE INVENTION

In one aspect the present invention broadly resides in a securing cap positionable between a wall and floor or ceiling mounting and engageable with said wall and said floor or ceiling mounting so that the engaged securing cap fixes the wall to the floor or ceiling mounting.

The securing cap is preferably positionable between a wall and floor ceiling mounting and engageable with said wall and said floor or ceiling mounting to fix the wall to the floor or ceiling mounting.

The securing cap may engage and fix the wall to the floor or ceiling mounting by any suitable means including snap fitting. Preferably the securing cap engages and fixes the wall to the floor or ceiling mounting by locking protrusions.

In another aspect the present invention broadly resides in a securing cap positionable between a wall and floor or ceiling mounting and engageable with said wall and said floor or ceiling mounting, whereby engagement locks the securing cap to the wall and floor or ceiling mounting and thereby fixing the wall to the floor or ceiling mounting.

Preferably the securing cap has one or more protrusions for engaging with the wall and floor or ceiling mounting. Preferably the securing cap has two spaced apart protrusions on each side.

Preferably the securing cap has a cover portion and one or more legs extending downwardly from the cover portion. Preferably one or more of said legs has one or more resiliently deformable locking protrusions for engagement by snap fit and fixing the wall to the floor or ceiling mounting. Preferably each of the protrusions extend laterally and outwardly from one or more of said legs. Preferably each of the protrusions is positioned on said leg to enable engagement with the floor or ceiling mounting. Preferably the cover portion abuts the wall and the floor or ceiling mounting along its contact length to provide additional fixing support.

Preferably the securing cap is resiliently deformable allowing it to be fitted between the wall and floor or ceiling mounting where the receiving space is smaller or differently shaped.

Preferably the cover portion is able to substantially close a space or opening between the wall and the floor or ceiling mounting thereby preventing the accumulation of dust and debris.

In another aspect the invention broadly resides in a wall assembly system including a plurality of wall panels for use to form a continuous wall;

a floor or ceiling mounting fixable to a floor or ceiling respectively; and a plurality of securing cap positionable between the wall and the floor or ceiling mounting, each of said securing caps is adapted to snap fit between said wall and said floor or ceiling mounting thereby fixing said wall with said floor or ceiling mounting.

The securing cap preferably includes one or more of the different forms as described above.

The wall preferably has at least one aperture for locating one or more resiliently deformable locking protrusions. The aperture within the wall is preferably oversized to accommodate for uneven floors. The aperture within the wall is preferably elongate and preferably is wider than the width of the protrusion.

Where the wall panel is corrugated, the cover portion of the securing cap is preferably suitably shaped to fix within the space formed between corrugations. With U-shaped wall panels that are preferably used in hallways, a plurality of the securing caps are preferably fitted adjacent each other within the U-shaped panel wall. With Formed, corrugated or S-shaped wall panels that are preferably used to form partitions and room walls, a single securing cap is preferably fitted within each defined space so that the securing caps are consecutively positioned on alternate sides of the Formed, corrugated or S-shaped panel wall.

Preferably the floor or ceiling mounting has a longitudinally disposed internal rib on opposing sides for engagement with the securing cap protrusions. Preferably the floor or ceiling mounting forms a channel within which the wall is mounted. With engagement, the protrusions preferably abut below the internal ribs of the channel, thereby fixing the wall to the floor or ceiling mounting. More preferably, the protrusions abut below the internal ribs of the channel and at least one of the protrusions passes through an aperture in the wall.

In another aspect the wall assembly system includes a plurality of wall panels for use to form a continuous wall;

a floor or ceiling mounting fixable to a floor or ceiling respectively; and a plurality of securing cap positionable between the wall and the floor or ceiling mounting, each of said securing caps is adapted to snap fit between said wall and said floor or ceiling mounting thereby fixing said wall with said floor or ceiling mounting, wherein the securing cap has a cover portion and one or more legs extending downwardly from the cover portion, one or more of said legs has one or more resiliently deformable locking protrusions for engagement by snap fit and fixing the wall to the floor or ceiling mounting, said one or more protrusions extend laterally and outwardly from one or more of said legs.

In another aspect the wall assembly system includes a plurality of wall panels for use to form a continuous wall;

a floor or ceiling mounting fixable to a floor or ceiling respectively; and a plurality of securing cap positionable between the wall and the floor or ceiling mounting, each of said securing caps is adapted to snap fit between said wall and said floor or ceiling mounting thereby fixing said wall with said floor or ceiling mounting, wherein the securing cap has a cover portion and one or more legs extending downwardly from the cover portion, one or more of said legs has one or more resiliently deformable locking protrusions for engagement by snap fit and fixing the wall to the floor or ceiling mounting, said one or more protrusions extend laterally and outwardly from one or more of said legs, said cover portion is positionable to abut the wall and the floor or ceiling mounting along its contact length to provide additional fixing support.

In another aspect the wall assembly system includes a plurality of wall panels for use to form a continuous wall;

a floor or ceiling mounting fixable to a floor or ceiling respectively; and a plurality of securing cap positionable between the wall and the floor or ceiling mounting, each of said securing caps is adapted to snap fit between said wall and said floor or ceiling mounting thereby fixing said wall with said floor or ceiling mounting, wherein the securing cap has a cover portion and one or more legs extending downwardly from the cover portion, one or more of said legs has one or more resiliently deformable locking protrusions for engagement by snap fit and fixing the wall to the floor or ceiling mounting, said one or more protrusions extend laterally and outwardly from one or more of said legs, said cover portion is positionable to abut the wall and the floor or ceiling mounting along its contact length to provide additional fixing support, wherein the cover portion is able to substantially close an opening between the wall and the floor or ceiling mounting thereby preventing the accumulation of dust and debris.

In another aspect the invention broadly resides in a wall assembly including a continuous wall formed from one or more wall panels;

a floor or ceiling mounting fixed to the floor or ceiling respectively and within which the continuous wall panels are positionable; and a plurality of securing caps positioned between the wall and the floor or ceiling mounting, each of said securing caps is adapted to snap fit between the said wall and said floor or ceiling mounting thereby fixing said wall with said floor or ceiling mounting.

The continuous wall panel section, floor or ceiling mounting and securing cap preferably includes one or more of the different forms as described above.

In another aspect the invention broadly resides in a method of assembling a wall including mounting the continuous wall as described above within the floor or ceiling mounting as described above;

fitting the securing cap in the form space between the wall and the floor or ceiling mounting to engage and fix the wall to the floor or ceiling mounting.

In another aspect the invention broadly resides in a structure such as a building or shed including a plurality of wall assemblies as described above and roofing means. In a preferred embodiment the structure is a building having U-shaped panels for forming a corridor or passageway walls and formed, corrugated or S-shaped panels for forming partition and room walls.

The use of the securing caps in the wall assemblies also avoids or limits the use of fasteners to fix the wall to the floor or ceiling mounting.

BRIEF DESCRIPTION OF THE DRAWINGS

In order that the present invention can be more readily understood and put into practical effect, reference will now be made to the accompanying drawings wherein.

DESCRIPTION OF THE PREFERRED EMBODIMENT

Figure 1:
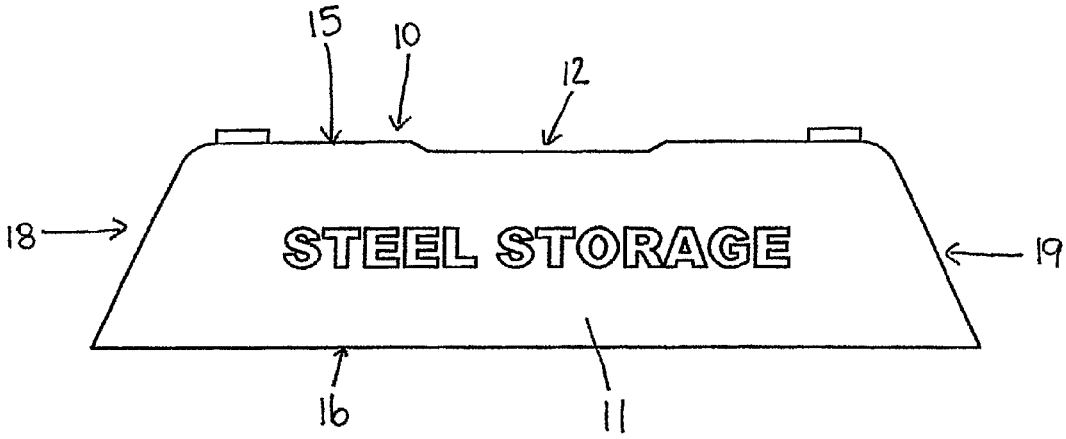
FIGS. 1 to 4 are alternate diagrammatic views of the preferred embodiment of the securing cap.
Figure 2:
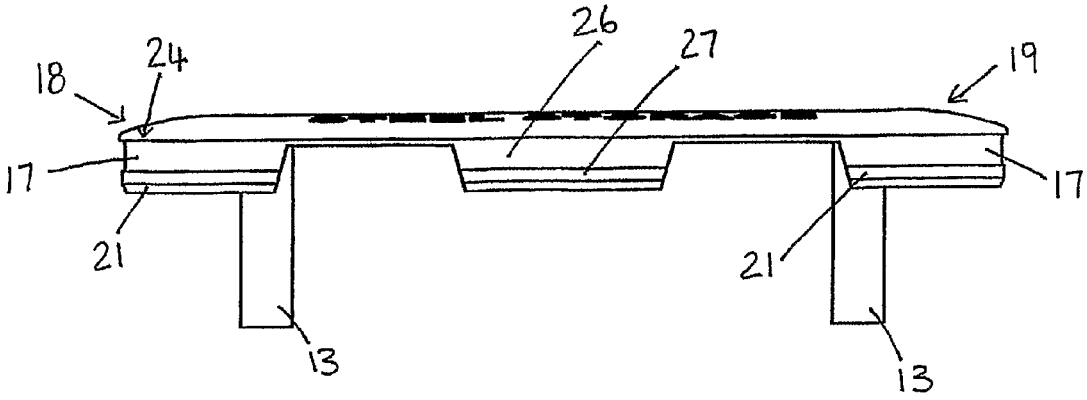
Figure 3:
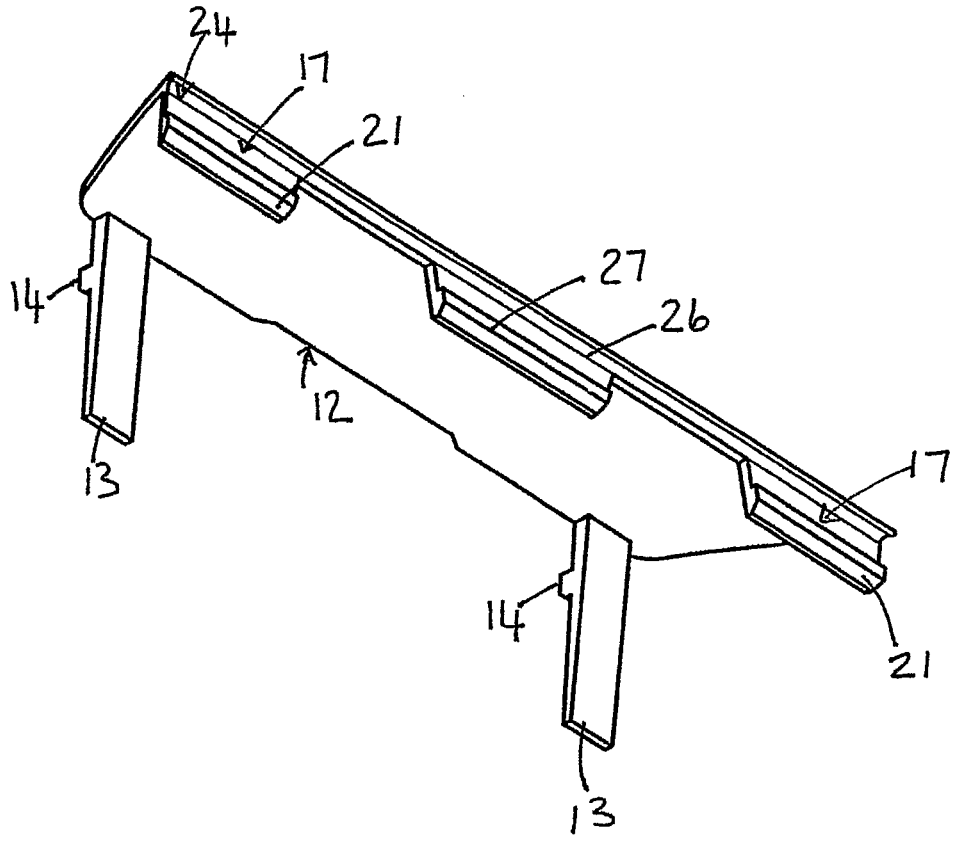
Figure 4:
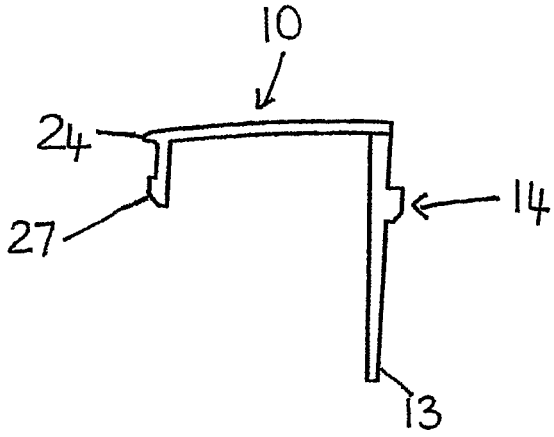

With reference to FIGS. 1 to 5, there is shown a securing cap 10 having a cover 11 shaped with a recess 12 for fitting within a wall panel and accommodating a corrugation. The securing cap 10 has two elongate legs 13 extending laterally from one side of the cover 11. The elongate legs 13 extend laterally from one side 15 of the cover 11 so that when the securing cap 10 is positioned within the wall panel the free end of each leg abuts the floor or ceiling mounting. In an alternative embodiment, the elongate leg is shorter and extends to a length where a protrusion extending outwardly from the leg is engageable with an internal rib on the floor or ceiling mounting when the securing cap is positioned within the wall panel.

The elongate legs 13 have protrusions 14 extending outwardly from each of the legs 13. The protrusions 14 extend outwardly part way along each leg 13 between the cover 11 and midpoint of the leg 13. The protrusions 14 serve to pass through an aperture in a wall panel and lock against the internal rib in the floor or ceiling mounting.

The securing cap 10 also has two flanges 17 extending laterally from the cover 11 substantially adjacent the opposite side 16 to legs 13. The flanges 17 are spaced apart extending laterally substantially from adjacent alternate ends 18, 19. The flanges 17 have elongate protrusions 21 extending outwardly from each of the flanges 17. A lip 24 is formed by the side 16 of the cover 11 and the flanges 17. The lip 24 and elongate protrusions 21 serve to fix the securing cap 10 in position within the wall panel.

The securing cap 10 also has a flange 26 extending laterally from substantially adjacent side 16 of the cover 11. The flange 26 is substantially centrally located. The flange 26 has an elongate protrusion 27. The flange 26 serves a similar function to flanges 17 but also serves to provide the securing cap 10 in position during fitting within the wall panel.

Figure 5:
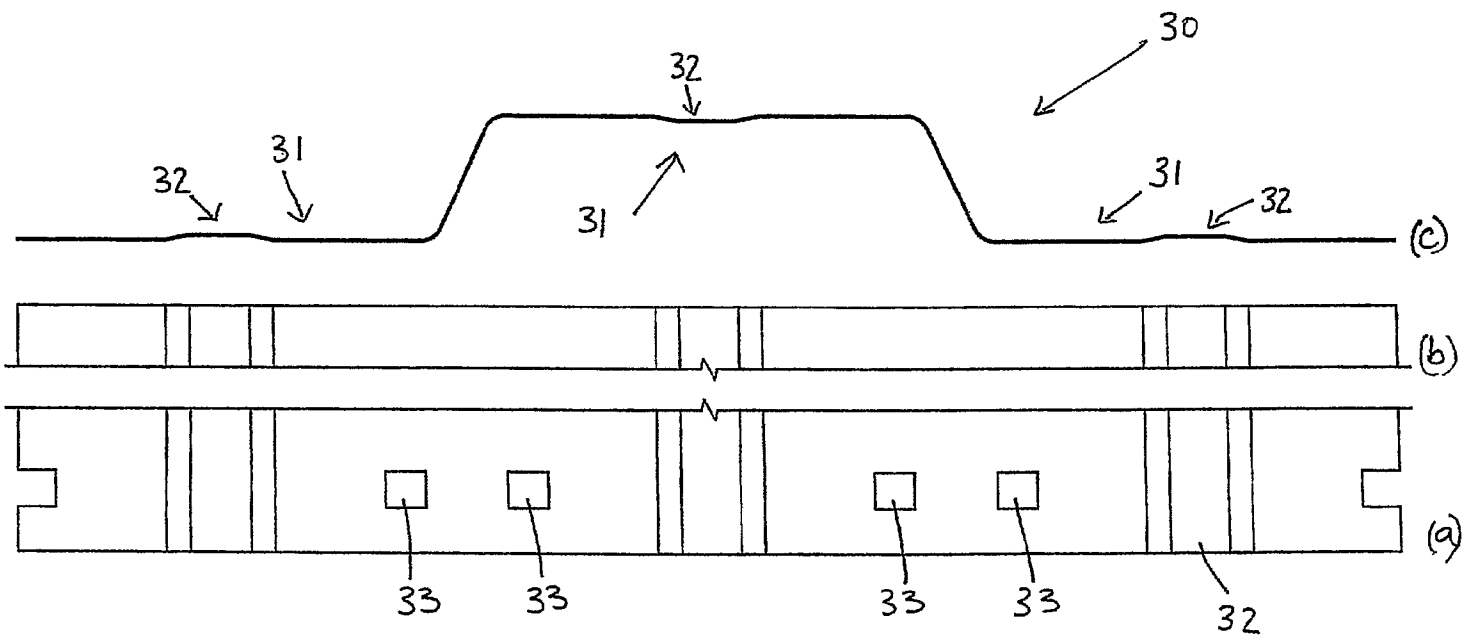
FIG. 5 are diagrammatic views of the corrugated or S-shaped wall panel where (a) is a front elevation view of the base portion of the panel, (b) is a front elevation view of an upper portion of the panel, and (c) is a top plan view of the panel.

With reference to FIG. 5, there is shown an S-shaped (or corrugated) wall panel 30 from different views. FIG. 5(*c*) shows the wall panel from a top plan view. The S-shaped or corrugated wall panel 30 forms recessed spaces 31 on alternate sides of the wall panel 30. Corrugations 32 in the wall panel 30 provide the wall panel 30 with additional strength. Apertures 33 in the top and base portions of the wall panel 30 allow protrusions extending from the securing cap to pass through to fix the wall panel with the floor or ceiling mounting.

Figure 6:
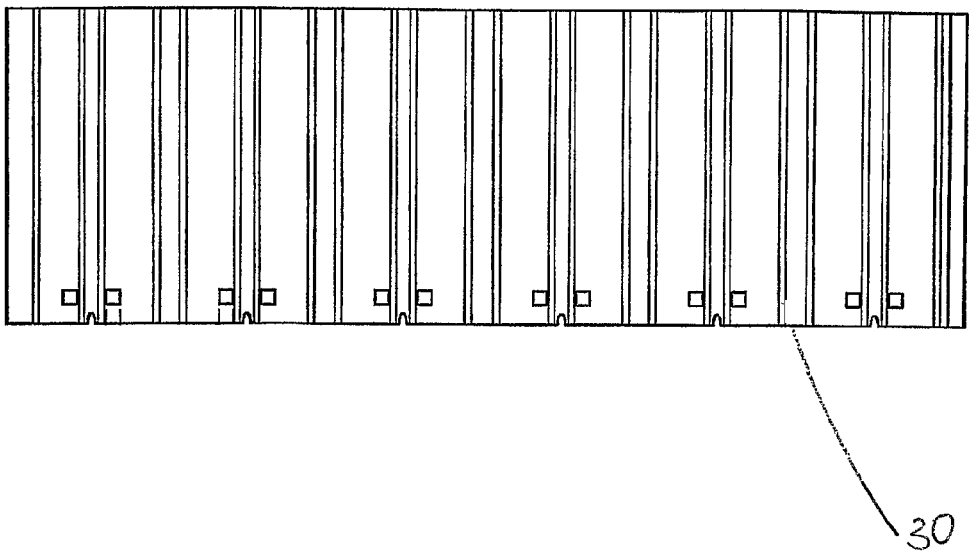
FIG. 6 are alternate diagrammatic views of the corrugated or S-shaped wall panel with (a) being an elevation view while (b) is a perspective view.
Figure 6:
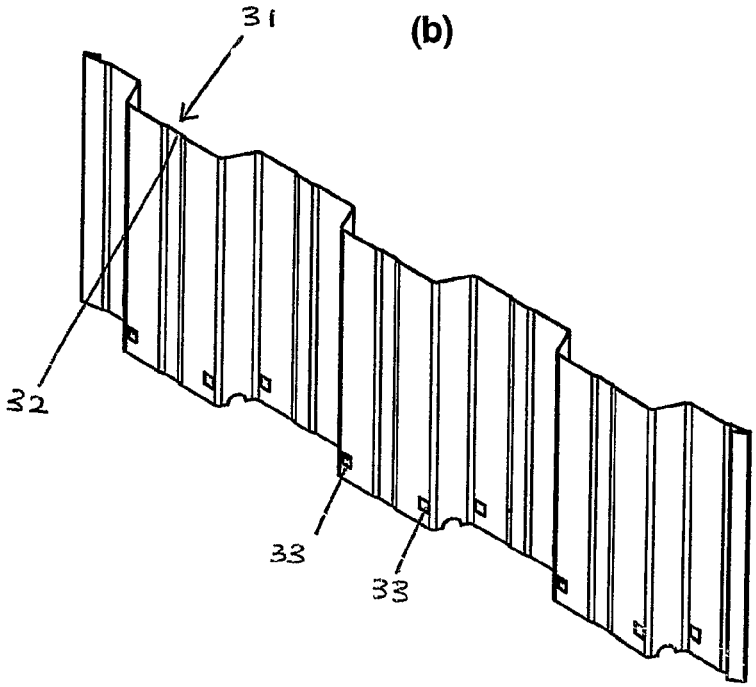
Figure 7:
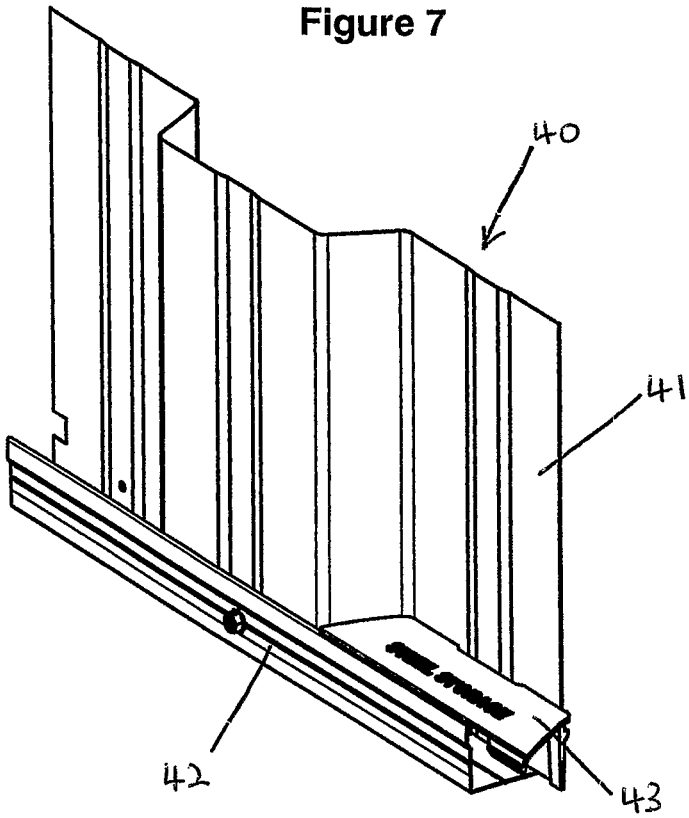
FIGS. 7 to 11 are alternate side front views of the securing cap positioned within the corrugated or S-shaped wall panel.
Figure 8:
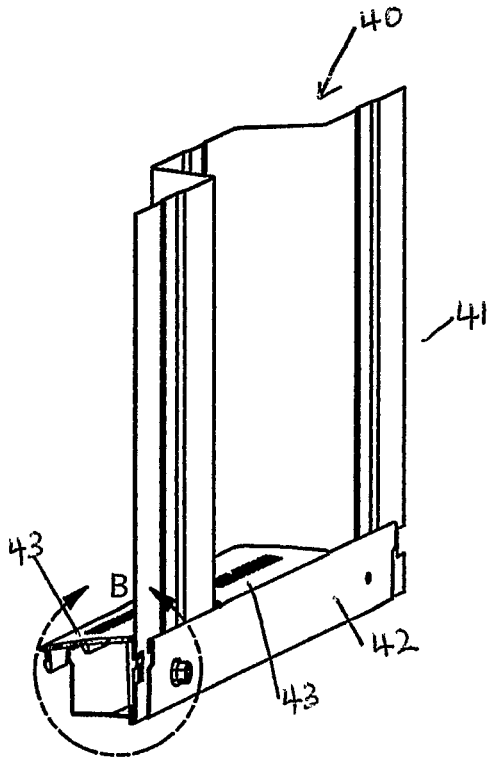
Figure 9:
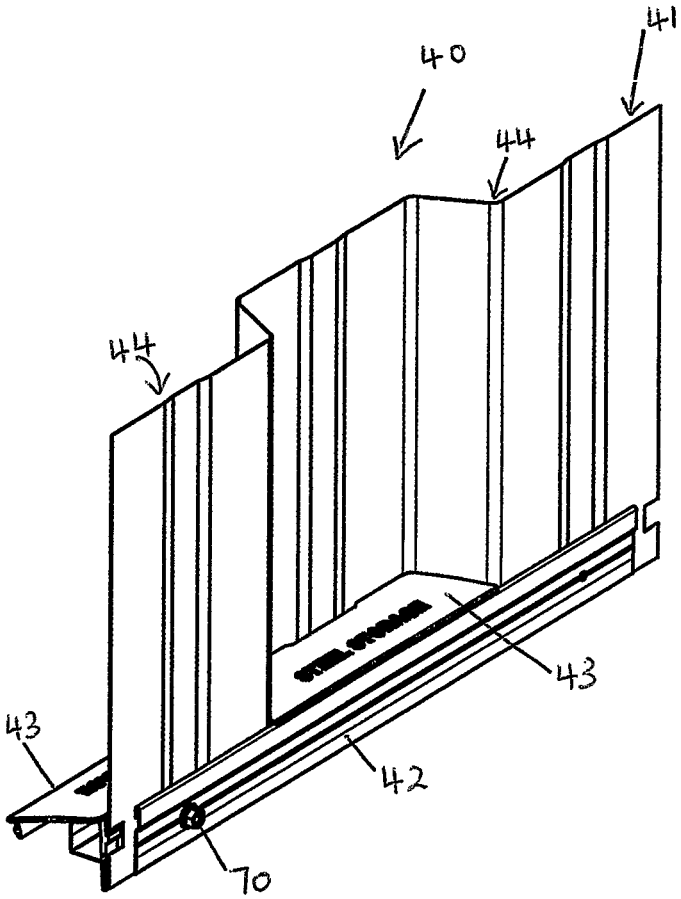
Figure 10:
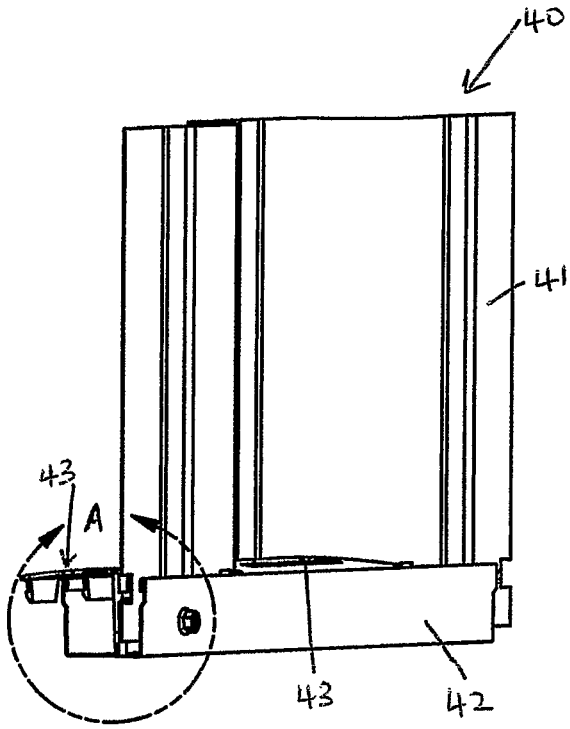
Figure 11:
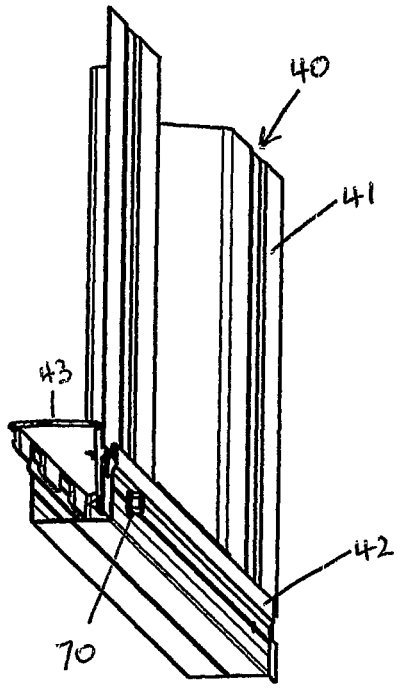
Figure 12:
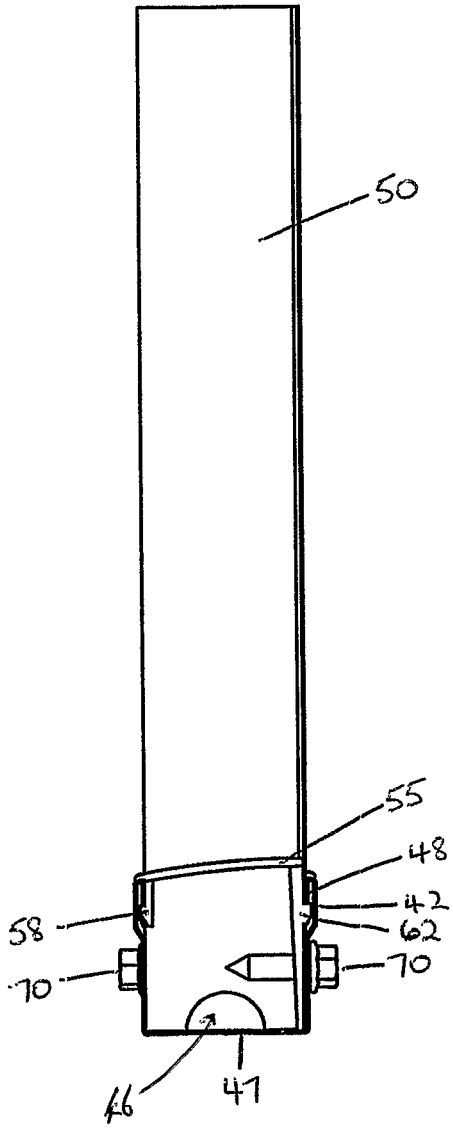
FIGS. 12 and 13 are cross-sectional views of the securing cap positioned within the corrugated or S-shaped wall panel.
Figure 13:
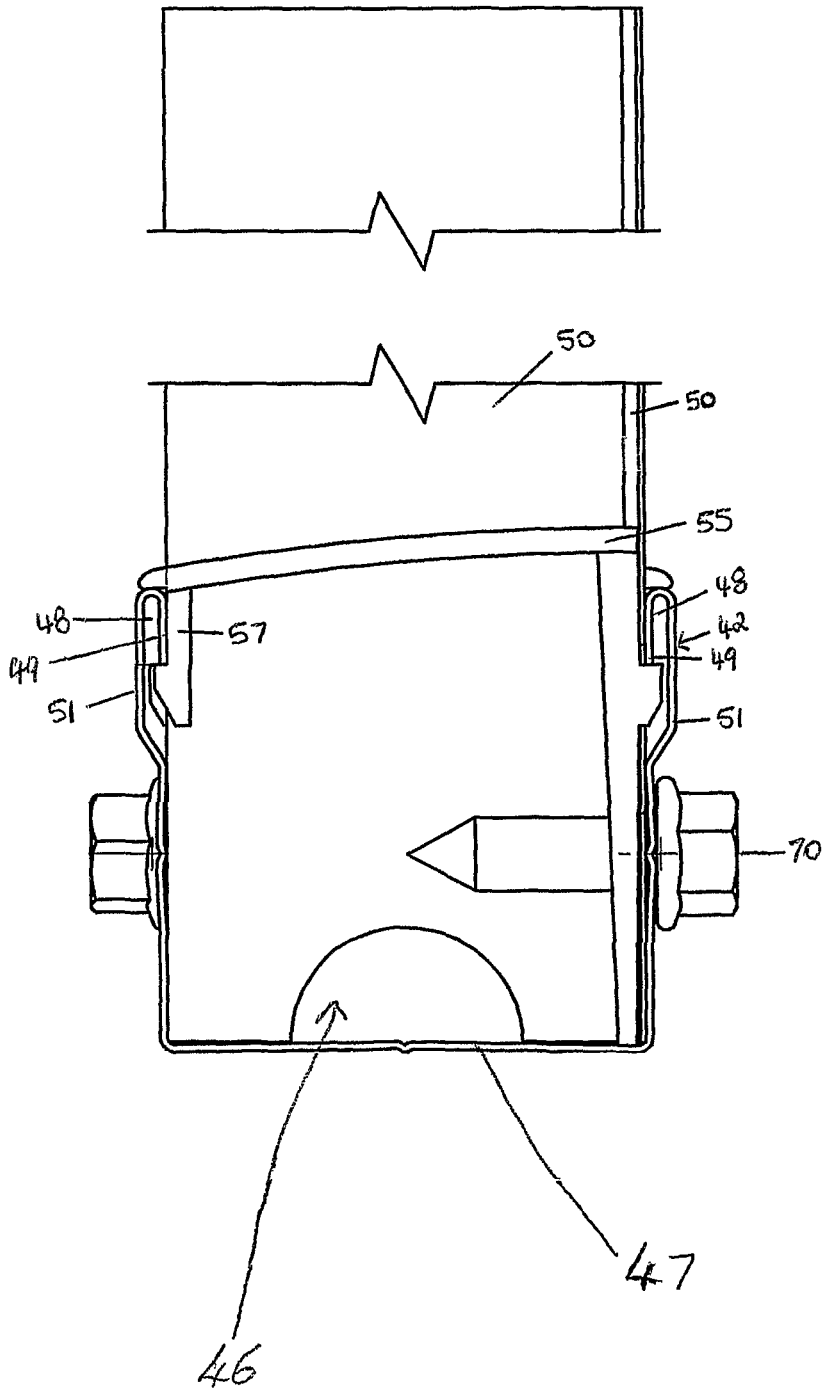
Figure 14:
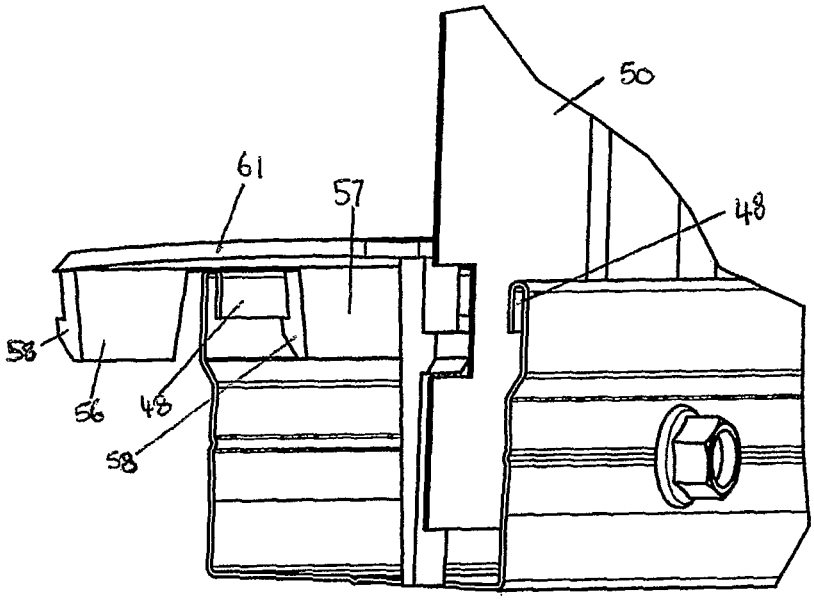
FIG. 14 is a cut-away view of the securing cap positioned within a wall panel as shown in A in FIG. 10.
Figure 15:
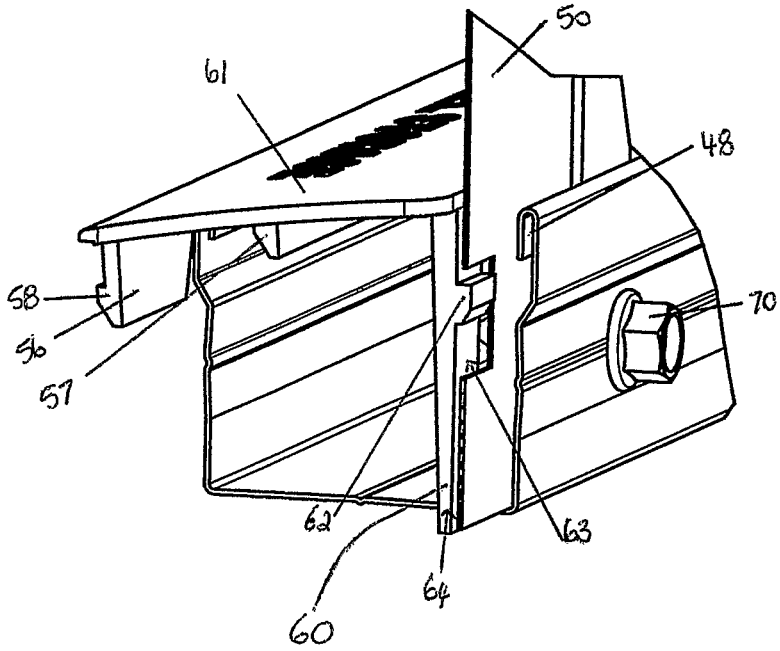
FIG. 15 is a cut-away view of the securing cap positioned within a wall panel as shown in B in FIG. 7.

FIG. 6 shows alternate views of the corrugated panel.

With reference to FIGS. 7 to 11, there is shown a wall assembly 40 including an S-shaped or corrugated wall panel 41, a substantially U shaped channel floor mounting 42 and securing caps 43 fixed in position within wall panel recesses 44 on alternate sides of the wall panel 41.

With further reference to FIGS. 12 to 15, the wall panel 50 has a scalloped portion 46 near its lower edge when in an installed position to allow the panel 50 to move freely along a length of channel and be secured by fasteners to the floor.

The securing cap 55 can be located within the wall panel 50 in a number of positions. The securing cap 55 can be located within the wall panel 50 so that the end flanges 56 extend over one of the sides 51 of the U-shaped channel floor mounting 42 while the central flange 57 is positioned against the internal surface of the side 51 thereby holding the securing cap 55 in position. Alternatively, both the end flanges 56 and central flange 57 can be located on the outside surface or internal surface of the side 51.

Both the end flanges 56 and central flanges 57 have protrusions 58 that are able to engage and abut return flange 48.

The elongate legs 60 extend from the cover portion 61 and have a protrusion 62 that can pass through aperture 63 within the wall panel 50 and fits against return flange 48. The aperture 63 is oversized to accommodate uneven floors or minor shape changes. The elongate leg 60 has a free end 64 which abuts the base 47 of the floor mounting 42. The abutting of the elongate leg 60 serves to assist in positioning the hit of the securing cap 55 within the wall panel and floor mounting. With engagement of the end flanges 56 and central flange 57 with one side 51 of the floor mounting and the engagement of the protrusion 62 on leg 60 and passing through wall panel 50 to engage and abut against return flange 48 on the other side 51 of the floor mounting 42, the wall panel 50 is fixed in position with the floor mounting 42.

The described wall assembly 40 can be used for partitioning walls and room walls where the securing cap 55 is fixed in recessed spaces 44 on consecutive alternate sides of the wall panel 50. To further secure the wall panel 50 to the floor mounting 42, a locking screw 70 may be fastened to all three components.

The securing cap 55 may also be used to fix U-shaped wall panels (not shown) to floor or ceiling mountings by positioning a plurality of securing caps 55 adjacent each other within the U shaped wall paneling. The fixing of the U-shaped wall paneling to the floor or ceiling mounting is similar to the fixing of the S-shaped wall paneling. The U-shaped wall panels are preferably used for corridors and passageways.

With the wall assembly, buildings and sheds can be constructed relatively quickly minimizing the number of fasteners needed to fix the walls and mountings. The securing cap also substantially prevents dust and debris from collecting in the U-shaped channel and provides a clean finish to the walls.

ADVANTAGES

The preferred embodiment of the invention provides the advantage that the securing cap can fix the wall panel to the floor channel without the use of fasteners, prevent dust and debris collecting in the flooring channels and hide any unsightly fasteners. Furthermore the preferred embodiment of the securing cap abuts and fixes the wall along the contact length thereby providing a more secure fixing than a single fixing point.

VARIATIONS

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Throughout the description and claims this specification the word "comprise" and variations of that word such as "comprises" and "comprising", are not intended to exclude other additives, components, integers or steps.

We claim:

1. A building wall assembly comprising:

one or more corrugated wall panels adapted to form a continuous wall;

a floor or ceiling mounting that may be fixed to a floor or ceiling, respectively, and within which the corrugated wall panels are positioned; and a plurality of securing caps, wherein each of said securing caps has a cover portion, one or more legs extending downwardly from a rear side of the cover portion, and one or more protrusions to engage with one of the one or more corrugated wall panels and a floor or ceiling mounting;

wherein each of said securing caps is positioned in and restricted to a single space formed between adjacent corrugations in the continuous wall and a floor or ceiling mounting, and wherein in use, each of said securing caps is positioned with a front side of the cover portion overlapping the floor or ceiling mounting and the rear side of the cover portion abutting the continuous wall and supported by the one or more legs to raise the height of the rear side of the cover portion so that the cover portion slopes downwardly from the rear side to the front side of the cover portion, each of said securing caps being engaged by snap fit arrangement to abut the continuous wall and the floor or ceiling mounting to enclose said single space and facilitate fixing of the continuous wall to the floor or ceiling mounting.

2. A building wall assembly as claimed in claim 1, wherein a separate securing cap is installed in each of said single spaces between adjacent corrugations along the continuous wall.

3. A building wall assembly as claimed in claim 1, wherein there are two legs of the one or more legs that extend downwardly from the rear side of the cover portion and a lip is formed on the front side of the cover portion.

4. A building wall assembly as claimed in claim 3, wherein there are three elongate flanges on the front side of the cover portion, said lip and elongate flanges cooperate to fix the securing cap to the floor or ceiling mounting.

5. A building wall assembly as claimed in claim 3, wherein, when installed, a free end of each of the legs abuts the floor or ceiling mounting.

6. A building wall assembly as claimed in claim 1, wherein the securing cap is resiliently deformable to fit and be accommodated in the single space formed between the corrugations in the wall and a floor or ceiling mounting and facilitates fixing the wall to the floor or ceiling mounting.

7. A building wall assembly as claimed in claim 1, wherein the floor or ceiling mounting forms a channel within which the wall is mounted and has a longitudinally disposed internal rib on opposing sides for engagement with the securing cap protrusions.

8. A building wall assembly as claimed in claim 7, wherein the protrusions abut below the internal ribs of the channel, thereby fixing the wall to the floor or ceiling mounting.

9. A building wall assembly comprising a mounting channel which may be secured to a floor or ceiling, at least one wall panel having one edge received in said channel, said wall panel having corrugations running perpendicular to said edge, whereby a space is defined between the corrugations, and a plurality of securing caps, each installed in a respective space between the wall panel and a respective one of said channels, each of said caps comprising a cover portion shaped to fill one of the spaces between the corrugations and the channel, at least one pair of legs extending generally perpendicular from a rear side of said cover portion for engaging said channel and retaining the cover portion in said space between the corrugations, each of the caps is positioned with a front side of the cover portion overlapping the floor or ceiling mounting and the rear side of the cover portion abutting the continuous wall and supported by the one or more legs to raise the height of the rear side of the cover portion so that the cover portion slopes downwardly from the rear side to the front side of the cover portion; at least a portion of the securing cap being resiliently deformable so that the cap fits and is retained within the channel when the cap is pushed into the channel, whereby each of said spaces is filled with a respective securing cap.

* * * * *